US012054681B2

(12) United States Patent
Jeon et al.

(10) Patent No.: US 12,054,681 B2
(45) **Date of Patent: *Aug. 6, 2024**

(54) SOLVENT COMPOSITION PREPARED FROM WASTE OIL AND METHOD OF PREPARING THE SAME

(71) Applicants: SK Innovation Co., Ltd., Seoul (KR); SK Geo Centric Co., Ltd., Seoul (KR)

(72) Inventors: Hee Jung Jeon, Daejeon (KR); Do Kyoung Kim, Daejeon (KR); Jeong Eop Choi, Daejeon (KR); Seung Woo Lee, Daejeon (KR); Yoon Kyung Lee, Daejeon (KR)

(73) Assignees: SK Innovation Co., Ltd., Seoul (KR); SK Geo Centric Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/736,376

(22) Filed: May 4, 2022

(65) Prior Publication Data

US 2022/0372383 A1 Nov. 24, 2022

(30) Foreign Application Priority Data

May 6, 2021 (KR) ..... 10-2021-0058328

(51) Int. Cl.
*C10G 67/08* (2006.01)
*C10G 45/58* (2006.01)

(52) U.S. Cl.
CPC ..... *C10G 67/08* (2013.01); *C10G 2300/1003* (2013.01); *C10G 2300/1007* (2013.01); *C10G 2300/202* (2013.01)

(58) Field of Classification Search
CPC ..... C10G 67/02; C10G 67/08; C10G 67/14; C10G 2300/1003; C10G 2300/1007;
(Continued)

(56) References Cited

U.S. PATENT DOCUMENTS 2,900,322 A 8/1959 Zoeller
5,107,061 A * 4/1992 Ou ..... A62D 3/34 585/642

(Continued)

FOREIGN PATENT DOCUMENTS

CN 101724426 A 6/2010
CN 102226103 A 10/2011

(Continued)

OTHER PUBLICATIONS

Viswanadham et al., "Octane number enhancement studies of naphtha over noble metal loaded zeolite catalytsts", Journal of Industrial and Engineering Chemistry, 2013, pp. 950-955, vol. 19.

(Continued)

*Primary Examiner* — In Suk C Bullock
*Assistant Examiner* — Jason Y Chong
(74) *Attorney, Agent, or Firm* — The Webb Law Firm

(57) ABSTRACT

Provided is a technology of converting an oil having a high content of Cl into a solvent. Impurities such as Cl, S, N, and metals are removed from an oil having a boiling point of 180 to 340° C. in a waste oil having a high content of Cl, and hydroisomerization is carried out, thereby applying an oil having a high isoparaffin ratio as a solvent. After a separation by boiling points according to the properties of the solvent product, a solid acid material and an oil having a high Cl content are mixed, impurities are removed by a heat treatment at a high temperature, and hydroisomerization is carried out by a noble metal/1-D zeolite catalyst, thereby, manufacturing a solvent product.

13 Claims, 1 Drawing Sheet

(58) Field of Classification Search
CPC ..... C10G 2300/201; C10G 2300/202; C10G 1/002; C10G 2400/18; C10G 7/003; C10G 7/006; C10G 45/34; C10G 45/60; C10G 45/64
See application file for complete search history.

(56) References Cited

U.S. PATENT DOCUMENTS

| | | | | |
|---|---|---|---|---|
| 5,866,748 | A | 2/1999 | Wittenbrink et al. | |
| 6,150,577 | A | 11/2000 | Miller et al. | |
| 6,288,296 | B1 | 9/2001 | Miller et al. | |
| 2009/0151233 | A1* | 6/2009 | Miller ..... | C10G 1/10 44/307 |
| 2009/0163391 | A1 | 6/2009 | Zakarian et al. | |
| 2012/0209017 | A1 | 8/2012 | Ouni et al. | |
| 2012/0251424 | A1 | 10/2012 | Havlik et al. | |
| 2016/0264874 | A1 | 9/2016 | Narayanaswamy et al. | |
| 2017/0263020 | A1 | 9/2017 | Huang et al. | |
| 2022/0235276 | A1 | 7/2022 | Paasikallio et al. | |

FOREIGN PATENT DOCUMENTS

| | | | |
|---|---|---|---|
| EP | 0803561 | A2 | 10/1997 |
| EP | 0697455 | B1 | 9/2001 |
| EP | 2489720 | A1 | 8/2012 |
| GB | 2388842 | A | 11/2003 |
| JP | H6228568 | A | 8/1994 |
| JP | 2005268612 | A | 9/2005 |
| JP | 2019519257 | A | 7/2019 |
| WO | 2020239729 | A1 | 12/2020 |

OTHER PUBLICATIONS

Miller et al., "Conversion of Waste Plastic to Lubricating Base Oil", Energy and Fuels, 2005, pp. 1580-1586, vol. 19, No. 4.

* cited by examiner

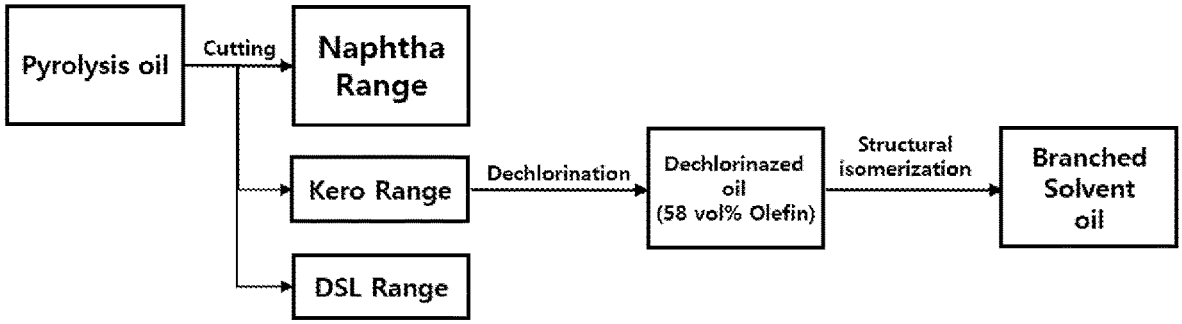
Pyrolysis oil
Cutting
Naphtha Range
Kero Range
DSL Range
Dechlorination
Dechlorinazed oil (58 vol% Olefin)
Structural isomerization
Branched Solvent oil

SOLVENT COMPOSITION PREPARED FROM WASTE OIL AND METHOD OF PREPARING THE SAME

CROSS-REFERENCE TO RELATED APPLICATION

This application claims priority to Korean Patent Application No. 10-2021-0058328 filed May 6, 2021, the disclosure of which is hereby incorporated by reference in its entirety.

BACKGROUND OF THE INVENTION

Field of the Invention

The following disclosure relates to a solvent composition prepared from a waste oil and a method of preparing the same.

Description of Related Art

Since a large amount of impurities from a waste material is included in an oil (waste oil) produced by a cracking or pyrolysis reaction of the waste material such as a waste plastic pyrolysis oil, when the waste oil is discarded or burned, it may be converted to hazardous gas such as greenhouse gas, or $SO_x$, $NO_x$, or Cl-containing gas.

Meanwhile, since conventional petroleum-based solvent compositions are products obtained by distilling low-boiling point hydrocarbon-based materials (C6-C10) in naphtha used in a petrochemical step and include high contents of an isoparaffin and a naphthene, it is difficult to adjust contents of a normal paraffin and an isoparaffin, and it is difficult to apply the solvent composition in practice due to its production costs.

Accordingly, since impurities in the waste oil are greatly removed, the waste oil has a higher content of a normal paraffin than a common petroleum-based solvent and a low content of impurities, and thus, a method of using a waste oil suitable for a solvent composition is needed.

Related Art Document 1 (JP 1994-228568 A) discloses a technology of catalytically cracking pyrolysis gas obtained by pyrolysis of a waste plastic material or a waste rubber material using a catalyst which does not cause a decreased function by hydrochloric acid, thereby obtaining a hydrocarbon oil and improving a recovery rate of the hydrocarbon oil. However, in Related Art Document 1, the components of the prepared low-boiling point hydrocarbon oil only have the composition of 33.3 wt % of C7-C8 and 42.4 wt % of C9-C10, and the characteristics of having a low content of an olefin and high contents of a normal paraffin and an isoparaffin which are required for application to a solvent composition are not disclosed.

Related Art Document 2 (U.S. Ser. No. 15/085,445) discloses a technology of melting waste plastic to prepare a liquid hydrocarbon stream; performing a hydrogenation reaction with an existence of a hydroprocessing catalyst to prepare C5+ liquid hydrocarbons; performing dechlorination to a content of a chlorine compound of less than 3 ppm; and manufacturing a high value product in a steam cracker. However, in Related Art Document 2, the manufactured hydrocarbon product has a composition of PIONA (20/20/0/30/30), and it is difficult to use a hydrocarbon product containing low contents of a normal paraffin and an isoparaffin as a solvent composition.

Related Art Document 3 (JP 2019-519257) is a technology of adding value to a waste oil and relates to a method of producing olefins and aromatics. It is a technology of melting waste plastic to prepare pyrolysis oil by catalytic cracking, treating gases directly with a cracker, and subjecting a liquid to a hydrogenation treatment and then a cracker/reforming treatment to prepare light olefins such as C3 and C4 and aromatics. However, Related Art Document 3 has high investment costs due to the application of catalytic cracking technology. In addition, the oil subjected to hydrogenation is mostly a light oil due to the nature of the oil prepared by catalytic cracking, so that it is difficult to the oil as a solvent composition, and the oil has a high content of an olefin and consumes much $H_2$ in the hydrogenation, so that it is difficult to secure economic feasibility.

SUMMARY OF INVENTION

Technical Problem

Since pyrolysis oil of waste plastic has a large amount of impurities such as olefins, chlorine (Cl), sulfur (S), and nitrogen (N), it was difficult to convert the pyrolysis oil into petrochemicals. In particular, it was very difficult to convert the pyrolysis oil into petrochemicals such as solvents of which the specifications and physical property standards are determined. An embodiment of the present invention is directed to providing a technology of preparing a high-quality solvent having a high content of a branched paraffin (isoparaffin) composition from an oil corresponding to Kero/LGO in a waste plastic pyrolysis oil.

Since the solvent prepared from the present invention has a high content of a branched paraffin and a low content of a naphthene, it is superior to a petroleum-based solvent having a relatively high content of a naphthene and it is possible to prepare a solvent at an equivalent level to a solvent in a synthesis oil form formed of only a branched paraffin.

Solution to Problem

In one general aspect, a method of preparing a solvent composition from a waste oil includes the steps of: (a) reacting at least a part of a waste oil having a boiling point of 180 to 340° C. to remove impurities; and (b) hydroisomerizing the waste oil from which the impurities have been removed, wherein the hydroisomerized waste oil includes 5 to 40 wt % of isoparaffins with respect to a total weight.

Before step (a), a step of separating at least a part of the waste oil into a first oil, a second oil, and a third oil may be further included, wherein the first oil has a boiling point of 180 to 340° C., the second oil has a boiling point of lower than 180° C., and the third oil has a boiling point of higher than 340° C.

The waste oil may include a waste plastic pyrolysis oil, a biomass pyrolysis oil, a regenerated lubricating oil, a crude oil having a high chlorine content, or a mixture thereof.

In step (a), a mixture of the waste oil and a solid acid material is prepared, the mixture is reacted to remove impurities, and the impurities may be chlorine, nitrogen, sulfur, oxygen, or a combination thereof.

In step (b), the waste oil from which the impurities have been removed may include 10 ppm or less of chlorine and 0.1 to 40 wt % of an olefin with respect to the total weight.

The hydroisomerization step (b) is carried out with an existence of a hydroisomerization catalyst, the hydroisomerization catalyst includes a support and a metal supported on the support, the metal may be one or more selected from the group consisting of platinum (Pt), palladium (Pd), nickel (Ni), iron (Fe), copper (Cu), chromium (Cr), vanadium (V), and cobalt (Co), and the support may be one or more selected from the group consisting of alumina, silica, silica-alumina, zirconia, ceria, titania, zeolite, and clay.

A step (c) of separating the waste oil hydroisomerized in step (b) by boiling point may be included.

The hydroisomerization step (b) may satisfy the following Relation 1:

$$0.95<A/B<1.05 \quad \text{[Relation 1]}$$

wherein each of A and B is a weight average molecular weight of a waste oil from which impurities have been removed before and after hydroisomerization.

The hydroisomerization step (b) may produce 3 wt % or less of oil vapor and naphtha components with respect to the total weight of the waste oil from which impurities have been removed.

In another general aspect, a solvent composition prepared from a waste oil includes: 30 to 60 wt % of a normal paraffin, 5 to 40 wt % of an isoparaffin, 0.1 to 30 wt % of a naphthene, and 0 to 10 wt % of an aromatic.

The solvent composition may include 30 to 60 wt % of normal paraffins, 5 to 40 wt % of isoparaffins, 0.1 to 30 wt % of naphthenes, and 0 to 10 wt % of aromatics.

The solvent composition may include 70 wt % or more of C9-C20 Kero/LGO oil with respect to the total weight.

The solvent composition may include less than 3 wt % of olefins and 0.5 wt % or less of conjugated diolefins.

The solvent composition may include less than 10 ppm of chlorine (Cl), less than 10 ppm of sulfur (S), and less than 10 ppm of nitrogen (N).

Advantageous Effects of Invention

In the present invention, a waste oil having a specific boiling point range may be subjected to a treatment to remove impurities such as Cl, S, N, and metals and hydroisomerization, so as to be applied as a solvent.

The present invention may produce a solvent product having higher contents of a n-paraffin and an i-paraffin than a general petroleum-based solvent and a low content of impurities.

In addition, the present invention converts a waste oil, which, when discarded or burned, may be converted into greenhouse gas or hazardous gas such as SON, NOR, and Cl-containing gases, into an industrially widely used solvent, and thus, is preferred in terms of environmental protection.

BRIEF DESCRIPTION OF DRAWINGS

FIG. 1 is a schematic diagram of a method of preparing a solvent composition from a waste oil, according to an exemplary embodiment of the present invention.

DESCRIPTION OF THE INVENTION

Unless otherwise defined herein, all terms used in the specification (including technical and scientific terms) may have the meaning that is commonly understood by those skilled in the art. Throughout the present specification, unless explicitly described to the contrary, "comprising" any elements will be understood to imply further inclusion of other elements rather than the exclusion of any other elements. In addition, unless explicitly described to the contrary, a singular form includes a plural form herein.

In the present specification, "A to B" refers to "A or more and B or less", unless otherwise particularly defined.

In addition, "A and/or B" refers to at least one selected from the group consisting of A and B, unless otherwise particularly defined.

In the present specification, unless otherwise defined, boiling points (bp) of a first oil, a second oil, and a third oil refer to those measured at normal pressure (1 atm).

A method of preparing a solvent composition from a waste oil according to an exemplary embodiment of the present invention is provided. The method is characterized by including the steps of: (a) reacting at least a part of a waste oil having a boiling point of 180 to 340° C. to remove impurities; and (b) hydroisomerizing the waste oil from which the impurities have been removed, wherein the hydroisomerized waste oil includes 5 to 40 wt % of isoparaffins with respect to a total weight.

Before step (a), a step of separating at least a part of the waste oil into a first oil, a second oil, and a third oil may be further included, wherein the first oil has a boiling point of 180 to 340° C., the second oil has a boiling point of lower than 180° C., and the third oil has a boiling point of higher than 340° C. As the separation step, a known fractional distillation method such as atmospheric distillation and reduced pressure distillation may be applied.

The separated first oil is a waste oil having a boiling point of 180 to 340° C. and may include C9-C20 oils. The first oil may include 30 to 90 wt % of a normal paraffin, 0.1 to 30 wt % of an isoparaffin, 0.1 to 90 wt % of olefins, 0.1 to 20 wt % of a naphthene, and 0.1 to 20 wt % of an aromatic, and preferably, may include 40 to 70 wt % of a normal paraffin, 0.1 to 10 wt % of an isoparaffin, 5 to 60 wt % of olefins, 0.1 to 5 wt % of a naphthene, and 0.1 to 5 wt % of an aromatic.

In addition, the first oil may include 1 to 5000 ppm of Cl, 1 to 1000 ppm of S, and 10 to 5000 ppm of N, and preferably 5 to 300 ppm of Cl, 5 to 100 ppm of S, and 10 to 1000 ppm of N, as the impurities.

The first oil having a boiling point range of 180 to 340° C. has high contents of impurities and an olefin as compared with petroleum-based raw materials for preparing a solvent or synthesis oil raw materials for preparing a solvent which are conventionally used, and thus, it is difficult to convert the first oil into a solvent by a simple treatment. Thus, a pretreatment step for reducing the content of impurities such as Cl, N, and S and the content of an olefin in the oil is needed.

The second oil and the third oil are waste oils having boiling points of lower than 180° C. and higher than 340° C., respectively, and the second oil may include a C8 or lower oil and the third oil may include a C21 or higher oil. The second oil and the third oil include a high content of linear hydrocarbons, and may generally have a higher ratio of a paraffin though the content ratio between a paraffin and an olefin varies depending on the method of preparing the waste oil (pyrolysis oil), include a small amount of a branched hydrocarbon, and include a small amount of naphthenes and aromatics resulted from the waste oil. Since the second oil has an impurity content higher than those of the first oil and the third oil, and requires a high-level impurity treatment technology, the second oil is not preferred in terms of economic feasibility by productization. The third oil may be present in a wax form at room temperature. The third oil may be converted into a lubricating base oil by a structural isomerization after removing impurities (such as Cl, N, and S) which may cause catalyst deactivation and step abnormality according to step standards, or may be converted into a petrochemical material having a smaller molecular weight by a second treatment such as cracking.

A C8 or lower hydrocarbon is in the most preferred area as a solvent, but since the amount recovered from the pyrolysis oil is small and the impurity content is high, it may be difficult to secure economic feasibility by an impurity reduction treatment. Since a medium-high hydrocarbon of C21 or higher has good lubricity but low meltability, it is not appropriate for use as a solvent. The object of the present invention is to separate linear hydrocarbons in a Kero/LGO boiling point range (C9-C20) where a solvent product group exists separately and apply the separated hydrocarbons as a solvent after a post-treatment. In addition, the present invention may provide a solvent composition having excellent low-temperature properties by subjecting a waste oil to structural isomerization in a hydroisomerization step (post-treatment).

Meanwhile, the waste oil may include a waste plastic pyrolysis oil, a biomass pyrolysis oil, a regenerated lubricating oil, a crude oil having a high chlorine content, or a mixture thereof. Since a large amount of impurities produced from a waste material is included in the waste oil produced by a cracking or pyrolysis reaction of the waste material such as a waste plastic pyrolysis oil, when the waste oil is used, air pollutants may be released, and in particular, a Cl component may be converted into HCl and released in a high temperature treatment step, and thus, it is necessary to pretreat the waste oil to remove impurities.

In addition, the waste oil may include H-Naphtha (~C8, bp<150° C.) and Kero/LGO (C9-C20, bp 150-340° C.): VGO/AR (C21~, bp>340° C.) at a weight ratio of 50:50 to 90:10, a weight ratio of 50:50 to 80:20, at a weight ratio of 50:50 to 70:30, or at a ratio of 50:50 to 60:40. The waste oil used in the present invention may not proceed with oil hardening by catalytic cracking in the preparation of waste plastic pyrolysis oil. Since the waste oil is applied as a raw material, a solvent composition having a high content of isoparaffins to be desired in the present invention may be prepared in a high yield.

The impurity removal step (a) is to remove impurities by reacting at least a part of a waste oil having a boiling point of 180 to 340° C., for example, at least a part of the first oil, and it is preferred that the waste oil having a boiling point of 180 to 340° C. and a solid acid material are mixed to prepare a mixture which is then reacted to remove impurities.

A reaction of removing chlorine included at a high content in the impurities may be largely classified into two types. In one type, chlorine in a hydrocarbon structure may be converted into HCl through a reaction by an active site of a solid acid catalyst, and then converted into HCl or HCl and a small amount of organic Cl and discharged. In the other type, Cl may be directly bonded to an active site of the solid acid material and removed. However, a hydrotreating (HDT) step as a conventional technology is a technology of removing Cl by hydrogen injection ($H_2$ feeding), and specifically, organic-Cl in an oil vapor form may be removed. This is because the waste oil cracked by a hydrogenation reaction reacts with Cl to form organic Cl. Accordingly, since gas occurrence is increased, a product loss is large and the content of an olefin component included in the waste oil may be increased, which is thus not preferred.

The impurity removal step may be performed at a pressure of 1 bar or more and 100 bar or less under an inert gas atmosphere and a temperature of 200° C. or higher and lower than 380° C.

Specifically, the impurity removal step may be carried out under pressure conditions of 1 to 100 bar of $N_2$, 1 to 60 bar of $N_2$, or 1 to 40 bar of $N_2$. When the reaction is carried out under high vacuum or low vacuum conditions of less than 1 bar, a catalytic pyrolysis reaction occurs to decrease the viscosity and the molecular weight of the pyrolysis oil and change the composition of the oil product. In particular, Cl is bonded to an olefin to form organic Cl to be removed, thereby causing a product loss. However, when the pressure is more than 100 bar, reactor operation is difficult and step costs are increased, which is thus not preferred.

Meanwhile, the impurity removal step may be carried out under inert gas conditions, not under a hydrogen atmosphere. Thus, as described above, since the content of an olefin component included in the waste oil is decreased and formation of organic Cl is suppressed, there is no change in composition of the oil by boiling points before/after the hydroisomerization step in step (b), and a solvent composition having a high content of an isoparaffin may be prepared in a high yield.

In addition, the impurity removal step may be carried out at 200 to 380° C., 230 to 360° C., 240 to 340° C., or 260 to 335° C., preferably 260 to 280° C. or 295 to 335° C. In the temperature range described above, as the temperature raises, a Cl reduction effect may be increased. Specifically, operation at a low temperature of lower than 200° C. may greatly decrease a conversion catalytic reaction in which chlorine (Cl) contained in the waste oil is converted into hydrochloric acid (HCl). Thus, since increases in a catalyst content, reaction temperature/time, and the like for compensating for low Cl reduction performance are needed, it is somewhat disadvantageous to the treatment of the waste oil having a high content of Cl in terms of economic feasibility. In addition, operation at a high temperature of higher than 380° C. may decrease an oil yield due to the occurrence of gas components by cracking reaction activation.

The solid acid material includes a Bronsted acid, a Lewis acid, or a mixture thereof, and specifically, may be a solid material in which a Bronsted acid site or a Lewis acid site is present, and the solid acid material may be zeolite, clay, silica-alumina-phosphate (SAPO), aluminum phosphate (ALPO), metal organic framework (MOF), silica alumina, or a mixture thereof.

Meanwhile, the solid acid material is a solid material having a site capable of donating $H^+$ (Bronsted acid) or accepting a lone pair of electrons (Lewis acid), and allows derivation of various reactions such as cracking, alkylation, and neutralization depending on energy at an acid site. In the present invention, the solid acid material is activated in specific step conditions, thereby carrying out a catalytic conversion reaction to convert Cl into HCl. As a result, a high content of Cl in the waste oil may be reduced to a several ppm level, and product abnormality (for example, cracking) and a yield loss (in the case in which Cl is removed as organic Cl, the case in which the oil is cracked and removed as gas, and the like) may be minimized.

As the solid acid material, waste zeolite, waste clay, and the like which are discarded after use in a petrochemical step are used as they are or used after a simple treatment for further activity improvement. For example, a fluidized bed catalyst is used in a RFCC step in which a residual oil is converted into a light/middle distillate, and in order to maintain the entire activity of the RFCC step constant, a certain amount of catalyst in operation is exchanged with a fresh catalyst every day, and the exchanged catalyst herein is named RFCC equilibrium catalyst (E-Cat) and discarded entirely. RFCC E-Cat may be used as the solid acid material of the present invention, and RFCC E-Cat may be formed of 30 to 50 wt % of zeolite, 40 to 60 wt % of clay, and 0 to 30 wt % of other materials (alumina gel, silica gel, functional material, and the like). By using RFCC E-Cat as the solid acid material for reducing Cl in the waste oil having a high content of Cl, a difference in cracking activity is small as compared with the fresh catalyst, and costs are reduced through environmental protection and reuse.

A simple treatment may be needed in order to use the waste zeolite, the waste clay, and the like as the solid acid material of the step of the present invention, and when a material such as coke or oil physically blocks the active site of the solid acid material, the material may be removed. In order to remove coke, air burning may be performed or a treatment with a solvent may be performed for oil removal. If necessary, when the metal component affects the active site of the solid acid material and deactivates the active site, a DeMet step in which a weak acid or dilute hydrogen peroxide is treated at a medium temperature to remove the metal component may be applied.

As an example, a catalyst used for reducing impurities in the present invention may be subjected to air burning under a simple atmosphere to regenerate an active site. By the air burning at 450 to 550° C. under an atmosphere, catalyst regeneration is possible. Nitrogen ($N_2$) stripping performed at 450 to 550° C. under a nitrogen atmosphere may regenerate some active sites of the catalyst, but is not effective as compared with air burning.

In step (b), the solid acid material may be included at 5 to 10 wt %, preferably 7 to 10 wt %, and more preferably 8 to 10 wt % with respect to the total weight of the mixture. Within the range, as the amount of the solid acid material introduced is increased, a Cl removal effect is improved, and when the amount is 10 wt % or less, a cracking reaction in the oil may be suppressed.

In step (b), the waste oil from which the impurities have been removed may include 10 ppm or less, 9 ppm or less, 8 ppm or less, or 7 ppm or less of chlorine with respect to the total weight. Within the range of the chlorine content, production of organic Cl in an oil vapor form, production of organic-Cl by a reaction between a cracked waste oil and Cl, and an increase in the content of the olefin component may be suppressed in the hydroisomerization step (b). Thus, a solvent composition having a high content of an isoparaffin may be prepared in a high yield.

The waste oil from which the impurities have been removed may include 0.1 to 40 wt %, 0.1 to 20 wt %, 0.1 to 10 wt %, 0.1 to 5 wt %, or 0.1 to 1 wt % of an olefin with respect to the total weight. As the olefin content is higher, an amount of $H_2$ used (consumed amount) to be used in saturation in the hydroisomerization step is increased, so that it is disadvantageous to secure economic feasibility.

Meanwhile, the content of an olefin in the waste oil from which the impurities have been removed may be confirmed by a bromine number, and as an example, the bromine number of the waste oil from which the impurities have been removed (gram of Br adsorbed per 100 gram of the waste oil) may be 0.01 to 40 g/100 g, 0.01 to 20 g/100 g, 0.01 to 10 g/100 g, 0.01 to 1 g/100 g, or 0.1 to 1 g/100 g. In the impurity removal step of the present invention, most of the olefin in the waste oil may be removed by an oligomerization reaction and an alkylation reaction between an olefin and a branched paraffin. Thus, the average molecular weight and/or the viscosity of the waste oil may be somewhat increased, and an abnormal reaction, deterioration of product properties, and a product loss may be prevented.

In addition, the waste oil from which the impurities have been removed may include 0.5 wt % or less of a conjugated diolefin with respect to the total weight. A conjugated diolefin in the olefin may cause abnormal operation by gum occurrence during an operation step. In the present invention, the content of the conjugated diolefin may be decreased from 3 wt % or more before the impurity removal step (a) to 0.5 wt % or less after the reaction. Thus, the criteria of 1 wt % or less of the conjugated diolefin which are stable operation criteria are generally satisfied, thereby increasing stability in the process operation.

Subsequently, step (b) is for removing an olefin in the oil and increasing the content of branched hydrocarbons, and is a step of hydroisomerizing the waste oil from which impurities have been removed.

In the present invention, the impurities are removed without hydroisomerization in step (a), and then the hydroisomerization step (b) proceeds, so that the contents of chlorine and olefins in the oil may be decreased to a very small amount and also, abnormal reaction, deteriorated product properties, and a product loss are prevented, thereby preparing a solvent composition having a high content of an isoparaffin.

In step (b) of the method of preparing a solvent of an exemplary embodiment of the present invention, the waste oil from which impurities have been removed produced in step (a) may be subjected to a hydroisomerization (hydrogenated branching) reaction to produce a branched hydrocarbon. Here, by the hydroisomerization reaction, one or two or more branched hydrocarbons may be produced, but the present invention is not limited thereto.

In the oil for use as a solvent, an olefin should be almost absent. However, the waste oil such as a waste plastic pyrolysis oil has a very high content of an olefin of 50 mol %, and at this level, the olefin content is present at several mol % or more even after removing the impurities by the solid acid material, and thus, it may be difficult to apply it directly as a solvent. Therefore, the unsaturated double bond present in the molecule may be removed by saturation with hydrogen ($H_2$) through hydroisomerization. In the method of preparing a solvent composition of an exemplary embodiment of the present invention, a general hydroisomerization reaction for removing an unsaturated double does not proceed, and the unsaturated double bond may be removed by the hydroisomerization reaction and simultaneously, molecular branching may proceed.

The hydroisomerization step (b) may be carried out with an existence of a hydroisomerization catalyst of a general oil refining step. The hydroisomerization catalyst may include, for example, a support and a metal supported on the support, the metal may be one or more selected from the group consisting of platinum (Pt), palladium (Pd), nickel (Ni), iron (Fe), copper (Cu), chromium (Cr), vanadium (V), and cobalt (Co), and the support may be one or more selected from the group consisting of alumina, silica, silica-alumina, zirconia, ceria, titania, zeolite, and clay.

Meanwhile, the zeolite may be a mesopore zeolite, for example, EU-1, ZSM-35, ZSM-11, ZSM-57, NU-87, ZSM-22, EU-2, EU-11, ZBM-30, ZSM-48, ZSM-23, or a combination thereof, but is not limited thereto.

In addition, the content of the metal component in the catalyst may be, for example, 0.1 to 3 wt %, 0.3 to 1.5 wt %, or 0.3 to 1 wt % with respect to the total weight of the catalyst.

The hydroisomerization reaction of step (b) may be carried out using a batch reactor or a fixed bed reactor, and preferably, may be carried out using a fixed bed reactor having high productivity. Specifically, the hydroisomerization reaction of step (b) may be carried out using a fixed bed reactor, and thus, may be operated in a continuous manner. As such, when the fixed bed reactor is used, the reaction may be carried out with a supply of a hydrogen gas, and in order to increase reaction stability, the reaction may be carried out under a mixed inert gas such as nitrogen, argon, and helium.

A flow rate of the hydrogen gas to be introduced to the fixed bed reactor may be considered as one of the factors controlling reaction activity. Specifically, since the reaction is performed by a contact between a catalyst and a reactant, a retention time may be considered for controlling the reaction. Meanwhile, a weight hour space velocity (WHSV) using the fixed bed reactor may be in ranges of, for example, 0.01 to 50 $hr^{-1}$, specifically 0.1 to 3 $hr^{-1}$, and more specifically 0.5 to 1.5 $hr^{-1}$.

The hydroisomerization reaction of step (b) may be carried out under the conditions of a temperature of 140 to 400° C. and a $H_2$ pressure of 20 to 200 bar. Specifically, the hydroisomerization reaction of step (b) may be carried out under the conditions of a temperature of 150 to 350° C. and a $H_2$ pressure of 30 to 160 bar. The hydroisomerization reaction is carried out under the conditions of the temperature and the pressure, thereby further improving a yield of the branched hydrocarbon.

In addition, the hydroisomerization reaction of step (b) may further include a hydrogenation finish step. The hydrogenation finish step may be carried out for removing a double bond (that is, an olefin), considering the oxidation stability of a final product.

The catalyst used in the hydrogenation finish step may be a catalyst used in a hydrogenation reaction during a common oil refining step, and for example, may include an inorganic oxide support and a hydrogenated metal supported on the support. Specifically, the hydrogenated metal may be a metal selected from Groups 6, 8, 9, 10, 11, and 12, more specifically, may be Pt, Pd, Ni, Fe, Cu, Cr, V, Co, and the like alone or in combination, and for example, may be Pt and/or Pd. In addition, the inorganic oxide support may be, specifically, at least one or more supports of alumina, silica, silica-alumina, zirconia, ceria, titania, zeolite (for example, Y zeolite, specifically, a Si/Al mole ratio (SAR) of 12 or more), clay, SAPO, and AlPO.

The hydrogenation finish step may be carried out, in ranges of, for example, a temperature of 150 to 500° C., preferably 180 to 350° C., and more preferably 200 to 350° C., a $H_2$ pressure of 5 to 200 bar and preferably 20 to 180 bar, and a $H_2$/feed ratio (GOR) of 300 to 2000 $Nm^3/m^3$, preferably 500 to 1500 $Nm^3/m^3$. In addition, the hydrogenation finish step may be carried out in a continuous mode, for example, when carried out in a CSTR reactor, in a range of a weight hour space velocity (WHSV) of 0.1 to 5 $hr^{-1}$, preferably 0.1 to 3 $hr^{-1}$, and more preferably 0.1 to 1 $hr^{-1}$.

In addition, the present invention may further include a step of selectively removing a conjugated diolefin in the olefin before the hydroisomerization step. Since the conjugated diolefin is converted into gum and the like by forming an oligomer during the reaction step to derive operation trouble, a pretreatment hydrogenation step in which the conjugated diolefin is selectively removed, if necessary, depending on its content may be carried out, and the pretreatment hydrogenation step may be carried out before the hydroisomerization step. As the hydrogenation catalyst for selectively removing the conjugated diolefin, a noble metal or MoS-based catalyst is used, but since the step operation conditions may be more easily removed as compared with removal of an unsaturated double bond and removal of impurities such as S and N, the operation is performed in mild conditions as compared with the hydrogenation step operation conditions. In the case in which the impurity content in the oil is low and it is possible to apply a noble metal catalyst, for example, when a Pd/r-$Al_2O_3$ catalyst is applied, it is possible to sufficiently selectively remove the conjugated diolefin under low temperature and pressure conditions of 40-70° C. and 10-40 bar of $H_2$. Meanwhile, when a MoS-based catalyst is used, the temperature and hydrogen pressure conditions are high as compared with the operation conditions of the noble metal catalyst, but it is possible to perform the pretreatment hydrogenation step even under low temperature and hydrogen pressure conditions as compared with the hydrogenation reaction.

As the noble metal catalyst in the pretreatment hydrogenation step, for example, a catalyst in the form of a metal catalyst supported on a carrier may be used. Here, the metal catalyst may be nickel (Ni), platinum (Pt), palladium (Pd), rhodium (Rh), lutetium (Lu), or an alloy including two or more thereof, and the alloy may be, for example, a platinum-palladium alloy.

The MoS-based catalyst of the pretreatment hydrogenation step may selectively include, for example, Ni, Co, and the like as a cocatalyst metal, and if necessary, may include two metals as a mixture. The MoS-based catalyst may include a W metal instead of Mo, and also, may include Mo and W as a mixture. If necessary, the metal content and the catalyst pore distribution of the catalyst are adjusted to prepare a metal catalyst having a different reaction activity and may be adjusted to one reactor or each of sequential reactors separately. The metal (Mo or W) content of the catalyst may be 0.1 to 95 wt %, and more specifically 0.3 to 20 wt % with respect to 100 wt % of the catalyst. The Ni, Co, and the like may be generally supported at a low content as compared with Mo, but if necessary, may be supported at a content equal to or higher than Mo.

The hydroisomerization step (b) of the present invention may produce 3 wt % or less, 1 wt % or less, and preferably 0.1 to 1 wt % of the oil vapor and a naphtha component (boiling point of lower than 180° C.) with respect to the total weight of the waste oil from which impurities have been removed. In the conventional technology, a hydrocracking catalyst including zeolite is used to produce 10 wt % or more of a naphtha component and oil vapor in a hydrogenation reaction, but in the present invention, a hydroisomerization catalyst is used and an oil having reduced contents of impurities (chlorine) and an olefin is used as a raw material to suppress occurrence of oil vapor, and a solvent composition having a high content of an isoparaffin to be desired in the present invention may be obtained in a high yield.

Meanwhile, the oil vapor refers to a state in which oil droplets having a particle size of 1 to 10 μm are evaporated to be distributed in the form of fog, and the composition of the oil vapor may be light hydrocarbons such as $H_2$, C1-C4 hydrocarbons, organic-Cl.

$$0.95<A/B<1.05 \quad \text{[Relation 1]}$$

wherein each of A and B is a weight average molecular weight of a waste oil from which impurities have been removed before and after hydroisomerization.

As described above, the molecular weight distribution (boiling point distribution) in the waste oil before and after the hydroisomerization may be maintained at a constant level, thereby preparing a solvent composition including a C9-C20 Kero/LGO oil to be desired. In addition, when the value is less than the lower limit of Relation 1, the Kero/

LGO oil may be changed into an oil such as naphtha or oil vapor after the hydroisomerization, which leads to an abnormal reaction, deteriorated product properties, and a product loss.

In the present invention, as described above, production of organic Cl in an oil vapor form may be suppressed and a conventional problem of producing organic-Cl by a reaction between a cracked waste oil and Cl may be improved in the hydroisomerization step (b).

A method of preparing a solvent composition from a waste oil according to an exemplary embodiment of the present invention may further include the steps of: (b) a pretreatment hydrogenation step of selectively removing a conjugated diolefin in the olefin before the hydrogenation step.

The conjugated diolefin may be converted into gum and the like by forming an oligomer during a reaction process to derive operation trouble. Thus, it is preferred that a pretreatment hydrogenation step of selectively removing the conjugated diolefin from the oil, if necessary, depending on its content is performed before the hydrogenation step (b).

The pretreatment hydrogenation step may be carried out at 40 to 300° C. and at a $H_2$ partial pressure of 5 to 100 bar. Since the conjugated diolefin may be removed easily as compared with the cases of removal of an unsaturated double bond and removal of impurities such as S and N, the pretreatment hydrogenation step operation conditions may be milder than the hydrogenation step operation conditions.

Meanwhile, the catalyst used in the pretreatment hydrogenation step may be a noble metal or MoS-based catalyst which is similar to the catalyst of the hydrogenation step (b). Specifically, when the content of impurities in the oil prepared in the impurity removal step (a) is low, a noble metal catalyst is applied to carry out a pretreatment hydrogenation step. Here, when a Pd/r-$Al_2O_3$ catalyst is applied as an example of the noble metal catalyst, the conjugated diolefin may be sufficiently selectively removed even under mild conditions of 40 to 150° C. and a $H_2$ partial pressure of 10 to 40 bar. In addition, when a MoS-based catalyst is used, the temperature and the hydrogen pressure are somewhat higher as compared with the operation conditions of the noble metal catalyst, but the pretreatment hydrogenation step may be carried out even under the conditions of lower temperature and hydrogenation pressure than the hydrogenation reaction (b).

Meanwhile, the pretreatment hydrogenation step may be carried out, specifically, after the impurity removal step (a) and before the hydrogenation step (b), and thus, a problem in the conventional technology in which Cl is removed by $H_2$ feeding in a hydrotreating (HDT) step and the like, which is a waste oil being cracked and removed in an organic-Cl form, may be prevented.

The pretreatment hydrogenation step may be, as an example, a liquid hydrogenation step, and may be carried out in a fixed bed reactor. Specifically, the pretreatment hydrogenation may be carried out by continuously injecting a liquid waste oil from which the impurities have been removed to a fixed bed reactor filled with a pretreated hydrogenation catalyst and hydrogen in a counter-current or co-current direction. However, the present invention is not limited thereto.

The method of preparing a solvent composition from a waste oil of the present invention may further include (c) separating the waste oil hydroisomerized in step (b) by boiling point. As the separation step, a known fractional distillation method such as atmospheric distillation and reduced pressure distillation may be applied.

Another exemplary embodiment of the present invention provides a solvent composition prepared from the waste oil. The solvent composition may be a solvent composition prepared by the method of preparing a solvent composition from a waste oil according to an exemplary embodiment.

The solvent composition is characterized by including 30 to 60 wt % of a normal paraffin, 5 to 40 wt % of an isoparaffin, 0.1 to 30 wt % of a naphthene, and 0 to 10 wt % of an aromatic with respect to the total weight. Specifically, the composition may include 40 to 50 wt % or 43 to 50 wt % of a normal paraffin with respect to the total weight. The solvent composition may include 10 to 40 wt %, 20 to 40 wt %, or 25 to 40 wt %, 10 to 30 wt %, 20 to 30 wt %, or 25 to 30 wt % of an isoparaffin. The solvent composition may include 10 to 30 wt %, 15 to 30 wt %, 20 to 30 wt %, or 25 to 30 wt % of a naphthene. The solvent composition may include 0 to 5 wt %, 0 to 3 wt %, 0 to 1 wt %, or 0.1 to 0.5 wt % of an aromatic.

The solvent composition may include a C9-C20 Kero/LGO oil, and specifically, 70 wt % or more, preferably 80 wt % or more, and more preferably 90 wt % or more, 95 wt % or more, or 99 wt % or more of the Kero/LGO oil (C9-C20, bp 150-340° C.), with respect to the total weight of the solvent composition.

The solvent composition may include less than 3 wt %, less than 1 wt %, or less than 0.1 wt % of olefins and 0.5 wt % or less of conjugated diolefins. In addition, the solvent composition may include less than 10 ppm or less than 5 ppm of chlorine (Cl), less than 10 ppm or less than 3 ppm of sulfur (S), and less than 10 ppm or less than 3 ppm of nitrogen (N).

The solvent composition is separated by boiling points to prepare a first solvent composition to a fourth solvent composition according to the use.

The first solvent composition may include 90 wt % or more of a C8-C13 component, and the first solvent composition may include 40 to 60 wt % of a normal paraffin, 10 to 30 wt % of an isoparaffin, 15 to 35 wt % of a naphthene, and a balance of an aromatic, and specifically, may include 45 to 60 wt % of a normal paraffin, 15 to 30 wt % of an isoparaffin, 20 to 35 wt % of a naphthene, and a balance of an aromatic, with respect to the total weight.

The second solvent composition may include, for example, 90 wt % or more of a C11-C15 component with respect to the total weight. The second solvent composition may include 40 to 60 wt % of a normal paraffin, 10 to 30 wt % of an isoparaffin, 15 to 35 wt % of a naphthene, and a balance of an aromatic, and specifically, may include 45 to 60 wt % of a normal paraffin, 15 to 30 wt % of an isoparaffin, 20 to 35 wt % of a naphthene, and a balance of an aromatic.

The third solvent composition may include, for example, 90 wt % or more of a C12-C17 component with respect to the total weight. The third solvent composition may include 40 to 60 wt % of a normal paraffin, 10 to 30 wt % of an isoparaffin, 15 to 35 wt % of a naphthene, and a balance of an aromatic, and specifically, may include 40 to 55 wt % of a normal paraffin, 20 to 30 wt % of an isoparaffin, 20 to 35 wt % of a naphthene, and a balance of an aromatic.

The fourth solvent composition may include, for example, 90 wt % or more of a C14-C20 component with respect to the total weight. The fourth solvent composition may include 35 to 55 wt % of a normal paraffin, 20 to 40 wt % of an isoparaffin, 15 to 35 wt % of a naphthene, and a balance of aromatics, and specifically, may include 35 to 50 wt % of a normal paraffin, 25 to 40 wt % of an isoparaffin, 20 to 35 wt % of a naphthene, and a balance of aromatics.

Hereinafter, the preferred Examples and Comparative Examples of the present invention will be described. However, the following Examples are only a preferred exemplary embodiment of the present invention, and the present invention is not limited thereto.

Example 1. Analysis of Composition of Waste Oil (Waste Plastic Pyrolysis Oil) Having High Content of Cl and Separation of Kero/LGO Therefrom A waste oil (waste plastic pyrolysis oil) converted by pyrolysis of a plastic waste was used as a raw material for preparing a solvent. In order to confirm the effect of impurity removal and a molecular weight change by the reaction, the following analysis was performed. In order to confirm a molecular weight distribution in the waste plastic pyrolysis oil, GC-Simdis analysis (HT-750) was performed. ICP, TNS, EA-0, and XRF analyses were carried out for the impurities, Cl, S, N, and O. In addition, GC-MSD analysis was performed for olefin content analysis. The analysis results are shown in the following Tables 1, 2, and 3:

TABLE 1

| Cut Name | Expected carbon range | Boiling point (° C.) | Yield (wt %) |
|---|---|---|---|
| H-Naphtha. | ~C8 | <150 | 8.1 |
| KERO | C9~C17 | 150~265 | 24.4 |
| LGO | C18~C20 | 265~340 | 22.7 |
| VGO/AR | C21~ | >340 | 44.8 |
| SUM | — | — | 100 |

TABLE 2

| Pyrolysis oil | Cl | N | S | O |
|---|---|---|---|---|
| mg/Kg | 67 | 348 | 20 | 0.2 |

In order to recover a Kero/LGO oil which is an oil to be converted into a solvent by hydroisomerization, the waste oil was separated by boiling points using a distillation apparatus. H-naphtha was separated by a boiling point of −180° C. at a normal pressure, and a Kero/LGO mixture was separated by reduced pressure distillation on a basis of 180 to 340° C.

Hydrogenation step introduction criteria were determined on the basis of Cl which is an impurity causing the most serious problem in the hydrogenation step. A representative impurity which may cause device corrosion by HCl conversion is Cl, and the impurities other than Cl, such as N, S, O, metals are also removed simultaneously in the impurity reduction step. The contents of the impurities, Cl, S, N, and O in the separated Kero/LGO oil are shown in the following Table 3:

TABLE 3

| | Kero/LGO |
|---|---|
| Cl, wppm | 68 |
| S, wppm | 28 |
| N, wppm | 367 |
| O, wt % | 1.4 |

Example 2. Cl Reduction Reaction in Oil by Treating Solid Acid Material at High Temperature Example 2-1. Preparation of Solid Acid Material In order to remove Cl in the liquid Kero/LGO mixture of Example 1, a solid acid material was prepared. The solid acid material was a material having a Bronsted or Lewis acid site, and RFCC E-cat. was used. The physical properties of the RFCC E-cat used are shown in the following Table 4. In addition, the contents of impurities included in the catalyst are shown in Table 5.

TABLE 4

| Type | TSA ($m^2/g$) | ZSA ($m^2/g$) | MSA ($m^2/g$) | Z/M Ratio | PV (cc/g) | APD (Å) |
|---|---|---|---|---|---|---|
| RFCC E-cat | 122 | 36 | 86 | 0.42 | 0.20 | 67 |

In Table 4, TSA is a total specific surface area, ZSA is a zeolite specific surface area, MSA is a meso or larger pore specific surface area, Z/M is a ratio of the zeolite specific surface area (ZSA) to the meso or larger pore specific surface area (MSAQ), PV is a pore volume, and APD is an average pore diameter.

TABLE 5

| | RFCC E-cat | | | | | | | | | | |
|---|---|---|---|---|---|---|---|---|---|---|---|
| | Na | Ni | V | Fe | Mg | P | $La_2O_3$ | $CeO_2$ | $TiO_2$ | $SiO_2$ | $Al_2O_3$ |
| wt % | 0.13 | 0.53 | 1.21 | 0.65 | 0.07 | 0.56 | 0.69 | 0.10 | 0.78 | 40 | 53 |

The RFCC E-cat used was a catalyst having a total specific surface area of 122 $m^2/g$, a pore volume of 0.20 cc/g, and an average particle size of 79 μm.

Example 2-2. Cl Reduction in Kero/LGO Oil by Solid Acid Material 99.9 kg of the Kero/LGO oil recovered in Example 1 and 30 kg of RFCC E-cat. were introduced to a 200 L autoclave, $N_2$ purging was carried out three times, and it was confirmed that there was no leak in equipment by a leak test at 30 bar of $N_2$. Thereafter, $N_2$ was vented, the equipment was operated at 500 rpm under the conditions of 1 bar of $N_2$, and the temperature was raised to a reaction temperature of 180° C. Subsequently, the temperature was maintained at 180° C. for 6 hours, and was lowered to room temperature with stirring to complete the reaction. Thereafter, venting was performed at room temperature, the autoclave was released to recover a reactant and a waste catalyst, and filtration was performed to recover treated Kero/LGO. The reaction was repeated until a Cl content was 2 wppm or less. Important changes in the physical properties related to the solvent product before and after the reaction are shown in the following Table 6:

TABLE 6

| | Cl (ppm) | N (ppm) | S (ppm) | O (wt %) | Bromine number (g/100 g) | Diene value(g/100 g) |
|---|---|---|---|---|---|---|
| Kero/LGO_before reaction | 62 | 444 | 39 | 0.4 | 48.18 | 0.8 |
| Kero/LGO_after reaction | 3 | 1.4 | 15.9 | — | 0.64 | 0.1 |

Example 2-3. Structural Isomerization of Kero/LGO Oil Having Reduced Impurities

The Cl-reduced Kero/LGO oil recovered from Example 2-2 was subjected to a hydroisomerization reaction using a fixed bed continuous reactor. The hydroisomerization reaction was carried out by loading a catalyst for a structural isomerization reaction and a hydrogenation finish reaction in a layer in the fixed bed reactor. A Pt/zeolite catalyst having 1-dimensional pores was used in the hydroisomerization reaction and a $PtPd/SiO_2$—$Al_2O_3$ catalyst was used in the hydrogenation finish reaction. The physical properties of the used catalysts are shown in the following Table 7.

10 cc of the catalyst was loaded in the fixed bed continuous reactor, and the catalyst was activated by the following procedures. The temperature was raised to 120° C. at a rate of 2° C./min under the conditions of $N_2$ normal pressure 100 sccm and then maintained for 2 hours to remove the impurities on the surface of the catalyst. Thereafter, $N_2$ was changed to $H_2$, and a $H_2$ pressure was increased to 35 bar at a rate of 10 bar/10 min. Thereafter, the temperature was raised at a rate of 2° C./min, maintained at 150° C. for 2 hours, raised at a rate of 2° C./min, and maintained at 330° C. for 5 hours to subject the catalyst to reduction activation. Thereafter, the temperature was slowly lowered to 150° C., and the pressure was increased to 50 bar. Thereafter, the oil recovered in Example 2-2 was introduced at 0.02 sccm and maintained for 5 hours to wet the catalyst. Thereafter, the oil introduction amount was increased to 0.12 sccm, the temperature was raised to 270° C., and the sample after an initial stabilization step was recovered.

TABLE 7

| Catalyst | Surface area ($m^2/g$) Total | micro | external | pore volume (cc/g) | Average pore diameter (Å) | Metal dispersion (%) |
|---|---|---|---|---|---|---|
| Hydroisomerization catalyst | 199.4 | 71.9 | 127.5 | 0.34 | 69.5 | 73.1 |
| Hydrogeneration Finish catalyst | 366.1 | 15.8 | 350.3 | 0.74 | 81.0 | 66.7 |

Impurity analysis for the oil recovered before and after the catalyst reaction was performed, and the results are shown in the following Table 8. Referring to Table 8, the oil recovered in Example 2-2 includes 2.2 wppm of Cl and 1.3 wppm of S, but it was confirmed that the impurities were all removed by the hydroisomerization reaction of Example 2-3. In addition, the metal impurities such as Fe, Al, Na, and Ca were present at 1 ppm or less (trace). In addition, it was confirmed that a ratio of a saturate was 99% or more and the content of the aromatic was 1% or less. A bromine number representing an olefin content was at a level of 0.035 g/100 g, which means that there was almost no unsaturated double bond. It was confirmed that the composition obtained by the hydroisomerization of Example 2-3 had the physical properties appropriate for application as a solvent.

TABLE 8

| | Oil treated in Example 2-2 | Oil treated in Example 2-3 |
|---|---|---|
| Cl, wppm | 2.2 | trace (<1 ug/g) |
| N, wppm | <1.0 | 0.12 |
| S, wppm | 1.3 | 0.08 |
| O, wt % | <0.1 | <0.1 |
| Fe, wppb | | 0.4 |
| Al, wppb | | 7.9 |
| Na, wppb | | 11.4 |
| Ca, wppb | | 51.6 |
| Saturate, % | | >99 |
| Aromatic, % | | <1 |
| Bromine Number, g/100 g | 0.64 | 0.035 |

By 2D-GC analysis for the oil recovered in Example 2-3, contents of a n-paraffin, an iso-paraffin, a naphthene, and aromatics were confirmed, and are shown in the following Table 9. As a result of analysis, a high content of the n-paraffin of 44.91 wt % and a high content of the isoparaffin of 28.90 wt % were confirmed by hydroisomerization.

TABLE 9

| | n-Paraffin | i-Paraffin | Olefin | Naphthen | Aromatic | Total |
|---|---|---|---|---|---|---|
| C06 | 0.00 | 0.00 | | 0.07 | 0.00 | 0.07 |
| C07 | 0.00 | 0.05 | | 0.00 | 0.00 | 0.05 |
| C08 | 0.00 | 0.00 | | 0.01 | 0.00 | 0.01 |
| C09 | 0.06 | 0.01 | | 0.07 | 0.01 | 0.14 |
| C10 | 1.66 | 0.31 | | 0.80 | 0.00 | 2.77 |
| C11 | 4.89 | 1.76 | | 2.25 | 0.00 | 8.90 |
| C12 | 5.22 | 1.94 | | 2.67 | 0.00 | 9.84 |
| C13 | 4.99 | 2.74 | | 2.56 | 0.00 | 10.29 |
| C14 | 5.01 | 2.57 | | 2.47 | 0.00 | 10.06 |
| C15 | 5.00 | 2.67 | | 2.49 | 0.05 | 10.22 |
| C16 | 4.74 | 2.98 | | 2.36 | 0.08 | 10.14 |
| C17 | 4.26 | 2.77 | | 2.35 | 0.02 | 9.40 |
| C18 | 3.41 | 2.94 | | 2.21 | 0.06 | 8.62 |
| C19 | 2.34 | 2.22 | | 1.73 | 0.03 | 6.32 |
| C20 | 1.54 | 1.79 | | 1.36 | 0.03 | 4.75 |
| C21 | 0.81 | 1.33 | | 0.89 | 0.03 | 3.06 |
| C22 | 0.45 | 0.90 | | 0.79 | 0.01 | 2.15 |
| C23 | 0.26 | 0.74 | | 0.42 | 0.00 | 1.43 |
| C24 | 0.13 | 0.59 | | 0.21 | 0.00 | 0.93 |
| C25 | 0.07 | 0.28 | | 0.12 | 0.00 | 0.47 |
| C26 | 0.04 | 0.22 | | 0.00 | 0.00 | 0.26 |
| C27 | 0.02 | 0.10 | | 0.00 | 0.00 | 0.12 |
| Total | 44.91 | 28.90 | 0.00 | 25.82 | 0.36 | 100.00 |

Example 2-4. Review of Applicability of Hydroisomerized Kero/LGO Oil as Solvent

The composition and the physical properties of the hydroisomerized Kero/LGO oil recovered in Example 2-3 were analyzed to confirm the applicability as a solvent product. A high temperature simulated distillation test pattern (simdist pattern) of the oil is shown in the following Table 10.

[Table 10] LINK Excel.Sheet.12 "C:\\Users\\si12308\\AppData\\Local\\Microsoft\\Windows\\INetCache\\Content.0 utlook\\SJ0CX35Y\\PR 용제시제품생산 _200909 (003).xlsx" "D60 D86!R2C2:R19C4" \a \f 4 \h * MERGEFORMAT

| | | Oil (wt %) |
|---|---|---|
| Distillation, ° C. | IBP | 149.4 |
| | 5% | 175.8 |
| | 10% | 191.8 |
| | 15% | 205 |
| | 20% | 213.4 |
| | 30% | 234 |
| | 40% | 257.8 |
| | 50% | 276.8 |
| | 60% | 295 |
| | 70% | 310.4 |
| | 80% | 327.2 |
| | 85% | 335.8 |
| | 90% | 346.8 |
| | 95% | 365.8 |
| | FBP | 606.2 |

The oil recovered in Example 2-3 had a paraffin content of 75% and a naphthene content of 25%, and due to its high paraffin content, was confirmed to be differentiated as a low-odor de-aromatic solvent product. Since the oil was prepared by the hydroisomerization reaction, it showed a characteristic of a high isoparaffin content of 20% or more, and had very low contents of impurities such as olefins, Cl, S, and N, and thus, it was confirmed that there was no quality problem as a solvent.

The solvent products which may be prepared from the oil recovered in Example 2-3 are shown in the following Table 11:

TABLE 11

| Solvent product | Distribution of number of carbons | Paraffin (wt %) | Isoparaffin (wt %) | Naphthen (wt %) |
|---|---|---|---|---|
| D40 | C8~C13 | 52.0 | 22.3 | 25.7 |
| D80 | C11~C15 | 51.0 | 23.7 | 25.3 |
| D100 | C12~C17 | 48.9 | 26.2 | 24.9 |
| D130 | C14~C20 | 44.4 | 30.3 | 25.3 |

By the analysis of the physical properties of the sample, a solvent product which has no impurity, has mild odor properties, and has a high isoparaffin ratio to have excellent low temperature properties may be expected.

Although the exemplary embodiments of the present invention have been described above, the present invention is not limited to the exemplary embodiments but may be made in various forms different from each other, and those skilled in the art will understand that the present invention may be implemented in other specific forms without departing from the spirit or essential feature of the present invention. Therefore, it should be understood that the exemplary embodiments described above are not restrictive, but illustrative in all aspects.

The invention claimed is:

1. A method of preparing a solvent composition from a waste oil, the method comprising the steps of:

(a) reacting at least a part of a waste oil having a boiling point of 180 to 340° ° C. to remove impurities; and (b) hydroisomerizing the waste oil from which the impurities have been removed, wherein the hydroisomerized waste oil includes 5 to 40 wt % of isoparaffins with respect to a total weight, and wherein the step (a) is performed under an inert gas atmosphere and in the absence of a hydrogen atmosphere.

2. The method of preparing a solvent composition from a waste oil of claim 1, further comprising:

before step (a), separating at least a part of the waste oil into a first oil, a second oil, and a third oil, wherein the first oil has a boiling point of 180 to 340° ° C., the second oil has a boiling point of lower than 180° C., and the third oil has a boiling point of higher than 340° C.

3. The method of preparing a solvent composition from a waste oil of claim 2, wherein the waste oil includes a waste plastic pyrolysis oil, a biomass pyrolysis oil, a regenerated lubricating oil, a crude oil having a high chlorine content, or a mixture thereof.

4. The method of preparing a solvent composition from a waste oil of claim 1, wherein in step (a), a mixture of the waste oil and a solid acid material is prepared and the mixture is reacted to remove the impurities, and the impurities are chlorine, nitrogen, sulfur, oxygen, or a combination thereof.

5. The method of preparing a solvent composition from a waste oil of claim 4, wherein the solid acid material is a solid material in which a Bronsted acid site or a Lewis acid site is present.

6. The method of preparing a solvent composition from a waste oil of claim 5, wherein the solid acid material is zeolite, clay, silica-alumina-phosphate (SAPO), aluminum phosphate (ALPO), metal organic framework (MOF), silica alumina, or a mixture thereof.

7. The method of preparing a solvent composition from a waste oil of claim 1, wherein in step (b), the waste oil from which the impurities have been removed includes less than 10 ppm of chlorine and 0.1 to 40 wt % of an olefin with respect to the total weight.

8. The method of preparing a solvent composition from a waste oil of claim 1, wherein the hydroisomerization in step (b) is carried out with an existence of a hydroisomerization catalyst, the hydroisomerization catalyst includes a support and a metal supported on the support, the metal is one or more selected from the group consisting of platinum (Pt), palladium (Pd), nickel (Ni), iron (Fe), copper (Cu), chromium (Cr), vanadium (V), and cobalt (Co), and the support is one or more selected from the group consisting of alumina, silica, silica-alumina, zirconia, ceria, titania, zeolite, and clay.

9. The method of preparing a solvent composition from a waste oil of claim 1, further comprising:

(c) separating the waste oil hydroisomerized in step (b) by boiling points.

10. The method of preparing a solvent composition from a waste oil of claim 1, wherein the hydroisomerization in step (b) satisfies the following Relation 1:

$$0.95<A/B<1.05 \quad \text{[Relation 1]}$$

wherein each of A and B is a weight average molecular weight of a waste oil from which impurities have been removed before and after hydroisomerization.

11. The method of preparing a solvent composition from a waste oil of claim 1, wherein the hydroisomerization in step (b) produces 3 wt % or less of oil vapor and a naphtha component with respect to the total weight of the waste oil from which the impurities have been removed.

12. The method of preparing a solvent composition from a waste oil of claim 1, wherein the inert gas atmosphere is a $N_2$ atmosphere.

13. A method of preparing a solvent composition from a waste oil, the method comprising:

(a) reacting at least a part of a waste oil having a boiling point of 180 to 340° ° C. to remove impurities in the absence of a hydrogen atmosphere; and (b) hydroisomerizing the waste oil from which the impurities have been removed, wherein the hydroisomerized waste oil includes 5 to 40 wt % of isoparaffins with respect to a total weight, wherein in step (a), a mixture of the waste oil and a solid acid material is prepared and the mixture is reacted to remove the impurities, and wherein the impurities are chlorine, nitrogen, sulfur, oxygen, or a combination thereof.

* * * * *